US011629594B2

(12) United States Patent
Connell et al.

(10) Patent No.: US 11,629,594 B2
(45) Date of Patent: Apr. 18, 2023

(54) CUTTING HEAD FOR ROCK CUTTING MACHINE

(71) Applicant: Joy Global Underground Mining LLC, Warrendale, PA (US)

(72) Inventors: Alex Connell, Polk, PA (US); Ryan Stewart, Oil City, PA (US)

(73) Assignee: Joy Global Underground Mining LLC, Warrendale, PA (US)

( * ) Notice: Subject to any disclaimer, the term of this patent is extended or adjusted under 35 U.S.C. 154(b) by 0 days.

(21) Appl. No.: 17/466,707

(22) Filed: Sep. 3, 2021

(65) Prior Publication Data

US 2022/0074305 A1 Mar. 10, 2022

Related U.S. Application Data

(60) Provisional application No. 63/074,835, filed on Sep. 4, 2020.

(51) Int. Cl.
*E21C 25/10* (2006.01)
*E21C 27/02* (2006.01)

(52) U.S. Cl.
CPC ..... *E21C 25/10* (2013.01); *E21C 27/02* (2013.01)

(58) Field of Classification Search
CPC ..... E21C 25/10; E21C 27/02
See application file for complete search history.

(56) References Cited

U.S. PATENT DOCUMENTS 3,085,795 A * 4/1963 Snipe ..... E21C 27/02 299/87.1
6,779,850 B1 * 8/2004 Schibeci ..... B28D 1/188 299/87.1
10,323,364 B2 * 6/2019 Cochran ..... E02F 5/08
2014/0239700 A1 * 8/2014 Wachsmann ..... E21C 25/10 299/79.1
2016/0024919 A1 1/2016 Hall et al.
(Continued)

FOREIGN PATENT DOCUMENTS

GB 856226 A * 12/1960
GB 1163411 A * 9/1968
PL 156017 B1 1/1992
(Continued)

OTHER PUBLICATIONS

Polish Patent Office Action for Application No. P.438878 dated Feb. 7, 2022 (5 pages including English translation).
(Continued)

*Primary Examiner* — Janine M Kreck
(74) *Attorney, Agent, or Firm* — Michael Best & Friedrich LLP

(57) ABSTRACT

A cutting head for a mining machine includes a drum, a vane, and a cutting bit assembly positioned adjacent a surface of the vane. The drum includes a first end, a second end, and an outer surface, and the drum is rotatable about a drum axis. The vane is coupled to the outer surface of the drum and protrudes radially away from the drum axis. In some aspects, the vane includes a planar member extending at least partially around the drum axis and at least partially between the first end of the drum and the second end of the drum. In some aspects, the drum includes a plurality of planar walls extending between the first end and the second end.

21 Claims, 8 Drawing Sheets

(56) References Cited

U.S. PATENT DOCUMENTS

2016/0102549 A1* 4/2016 Defibaugh ..... E21C 35/18
299/53

FOREIGN PATENT DOCUMENTS

PL 70443 Y1 12/2018
WO 2016057964 A1 4/2016

OTHER PUBLICATIONS

Chinese Patent Office First Notice of Correction for Application No. 202122142575.5 dated Feb. 23, 2022 (3 pages including statement of relevance).
Polish Patent Office Action for Application No. P.438878 dated Sep. 16, 2022 (3 pages, including an English statement of relevance).

* cited by examiner

CUTTING HEAD FOR ROCK CUTTING MACHINE

REFERENCE TO RELATED APPLICATION

This application claims the benefit of prior-filed U.S. Provisional Patent Application No. 63/074,835, filed Sep. 4, 2020, the entire contents of which are incorporated by reference.

BACKGROUND

The present disclosure relates to rock cutting and excavation machines, and particularly to a cutting head for a longwall shearer.

A conventional shearer drum includes cutting bits positioned within bit holders. The drum includes a spiral vane having a loading fence extending along the outer perimeter of the vane. The fence urges cut material into the space between the vane surfaces, and the vane carries cut material from the mine face to a face conveyor behind the shearer drum. The vane includes notches formed along the loading fence, and bit holders are coupled to the vane in the notches.

SUMMARY

In one independent aspect, a cutting head for a mining machine includes a drum, a vane, and a cutting bit assembly positioned adjacent a surface of the vane. The drum includes a first end, a second end, and an outer surface, and the drum is rotatable about a drum axis. The vane is coupled to the outer surface of the drum and protrudes radially away from the drum axis. The vane includes a planar member extending at least partially around the drum axis and at least partially between the first end of the drum and the second end of the drum.

In some aspects, the vane includes multiple planar segments.

In some aspects, the vane is a first vane, and the cutting head further includes at least one additional vane spaced apart from the first vane about the drum axis, the additional vane including at least one planar member.

In some aspects, the drum includes a face plate extending radially outwardly from the outer surface adjacent the first end, and a discharge plate extending radially outwardly from the outer surface adjacent the second end.

In some aspects, the drum has a cylindrical profile as viewed along the drum axis.

In some aspects, the drum has a polygonal profile as viewed along the drum axis.

In some aspects, each of the cutting assemblies includes a bit removably secured within a bit block.

In some aspects, each cutting bit assembly is secured to at least one of the drum and the vane, and each of the cutting bit assemblies is positioned adjacent a surface of the vane to facilitate loading of cut material onto the surface of the vane.

In another independent aspect, a cutting head for a mining machine, the cutting head includes a drum, a vane, and a cutting bit assembly positioned adjacent a surface of the vane. The drum includes a first end and a second end, and the drum is rotatable about a drum axis. The drum includes a plurality of planar walls extending between the first end and the second end. The vane is coupled to an outer surface of the drum and protrudes radially away from the drum axis.

In some aspects, the drum includes a face plate extending radially outwardly from the outer surface adjacent the first end, and a discharge plate extending radially outwardly from the outer surface adjacent the second end, the face plate including a plurality of plates, each of the plates associated secured to an end of an associated one of the planar walls of the drum.

In some aspects, the drum has a polygonal profile as viewed along the drum axis.

In some aspects, the drum has a hexagonal profile as viewed along the drum axis.

In some aspects, the vane includes multiple planar segments.

In some aspects, the vane is a first vane, and the cutting head further includes at least one additional vane spaced apart from the first vane about the drum axis, and the additional vane includes at least one planar member.

In some aspects, the vane includes a planar member extending at least partially between the first end of the drum and the second end of the drum.

In some aspects, each of the cutting assemblies includes a bit removably secured within a bit block.

In some aspects, each cutting bit assembly is secured to at least one of the drum and the vane, each of the cutting bit assemblies is positioned adjacent a surface of the vane to facilitate loading of cut material onto the surface of the vane.

In yet another independent aspect, a cutting device for a rock cutting machine includes an arm supported for pivoting movement, a drum, a vane, and a plurality of cutting bit assemblies secured to at least one of the drum and the vane. The drum includes a first end and a second end. The first end of the drum is supported on the arm, and the drum is rotatable relative to the arm about a drum axis. The drum includes a plurality of planar surfaces forming a polygonal profile. The vane is coupled to the outer surface of the drum and protrudes radially away from the drum axis. The vane includes a planar member extending at least partially around the drum axis and at least partially between the first end of the drum and the second end of the drum. Each of the cutting bit assemblies is positioned adjacent a surface of the vane to facilitate loading of cut material onto the surface of the vane.

In some aspects, the drum has a polygonal profile as viewed along the drum axis.

In some aspects, the vane includes multiple planar segments.

Other aspects will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. The use of "including," "comprising" or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Terms of degree, such as "substantially," "about," "approximately," etc. are understood by those of ordinary skill to refer to reasonable ranges outside of the stated relationship, for example, general tolerances associated with manufacturing, assembly, and use of the described embodiments.

Figure 1:
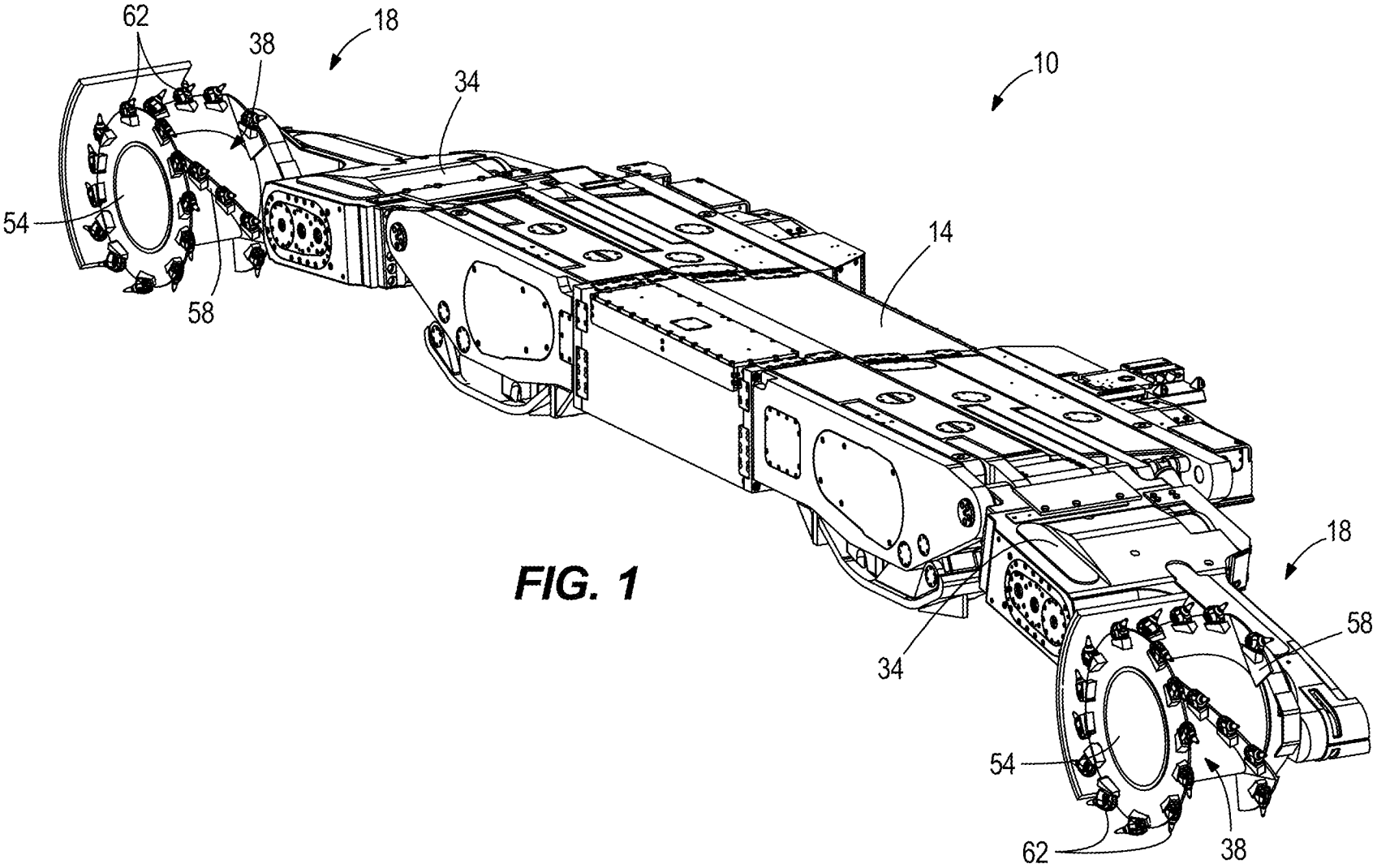
FIG. 1 is a front perspective view of a mining machine including a cutter head.
Figure 2:
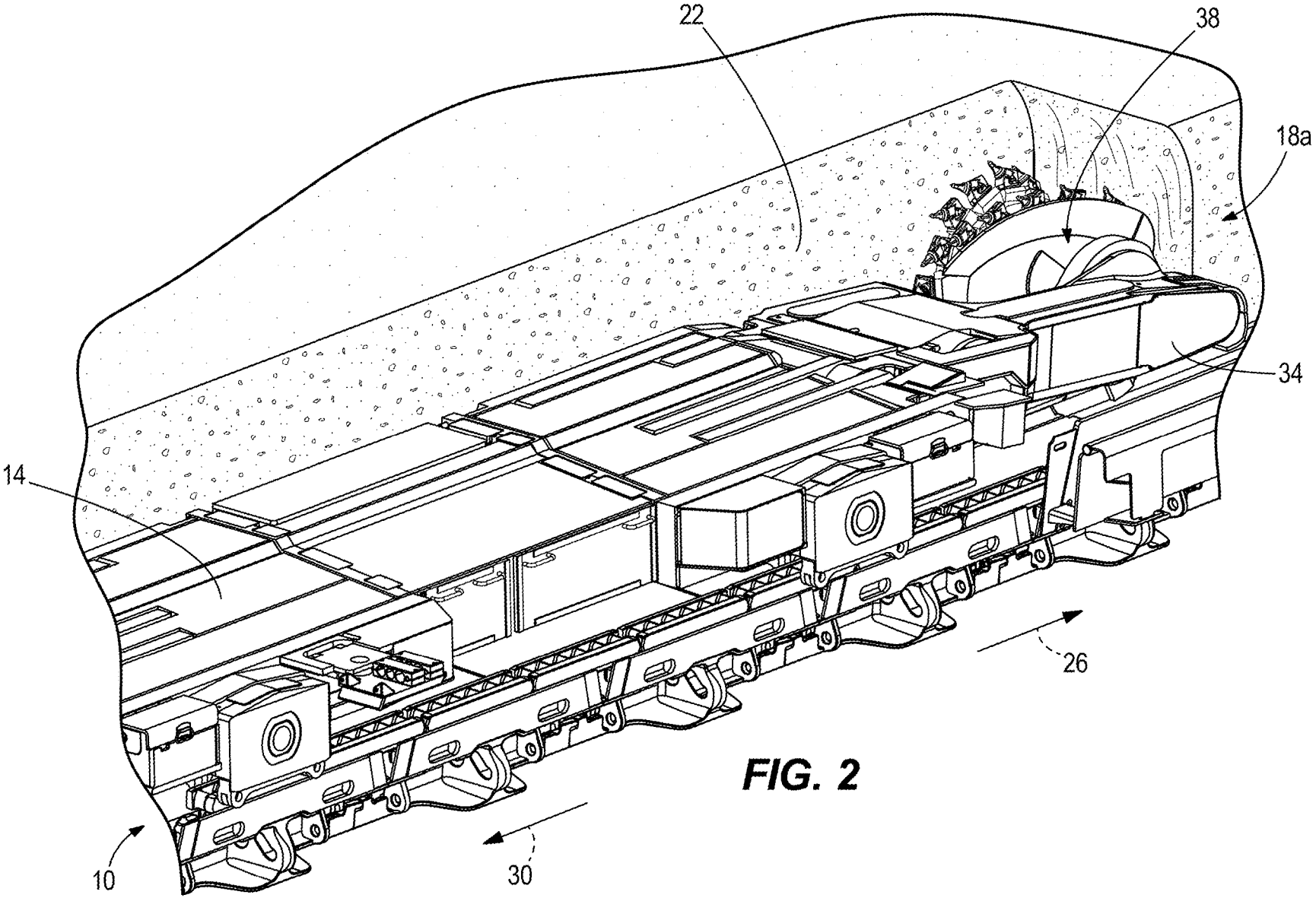
FIG. 2 is a rear perspective view of the mining machine of FIG. 1 with the cutter head engaging a mine face.

FIG. 1 illustrates a longwall shearer 10 including a frame or chassis 14 and a pair of cutting assemblies 18. As shown in FIG. 2, the chassis 14 is configured to tram along a mine face 22 in a first direction 26 and a second direction 30 opposite the first direction 26. As the chassis 14 moves in the first direction 26, a first cutting assembly 18*a* is in a leading position and a second cutting assembly (not shown) is in a trailing position. In one embodiment, the first cutting assembly 18*a* is elevated to cut material (e.g., coal or other minerals) from an upper portion of the mine face 22, while the second cutting assembly is in a lower position to cut material from a lower portion of the mine face 22.

Referring again to FIG. 1, each cutting assembly 18 includes a ranging arm 34 and a cutting head 38. One end of the ranging arm 34 is pivotably coupled to the chassis 14 and another end supports the cutting head 38 for rotation. The ranging arm 34 is pivoted related to the chassis 14 in order to position the cutting head 38, including raising and lowering the cutting head 38. Each cutting head 38 includes a drum 54, flights or vanes 58, and a plurality of cutting bit assemblies 62.

Figure 3:
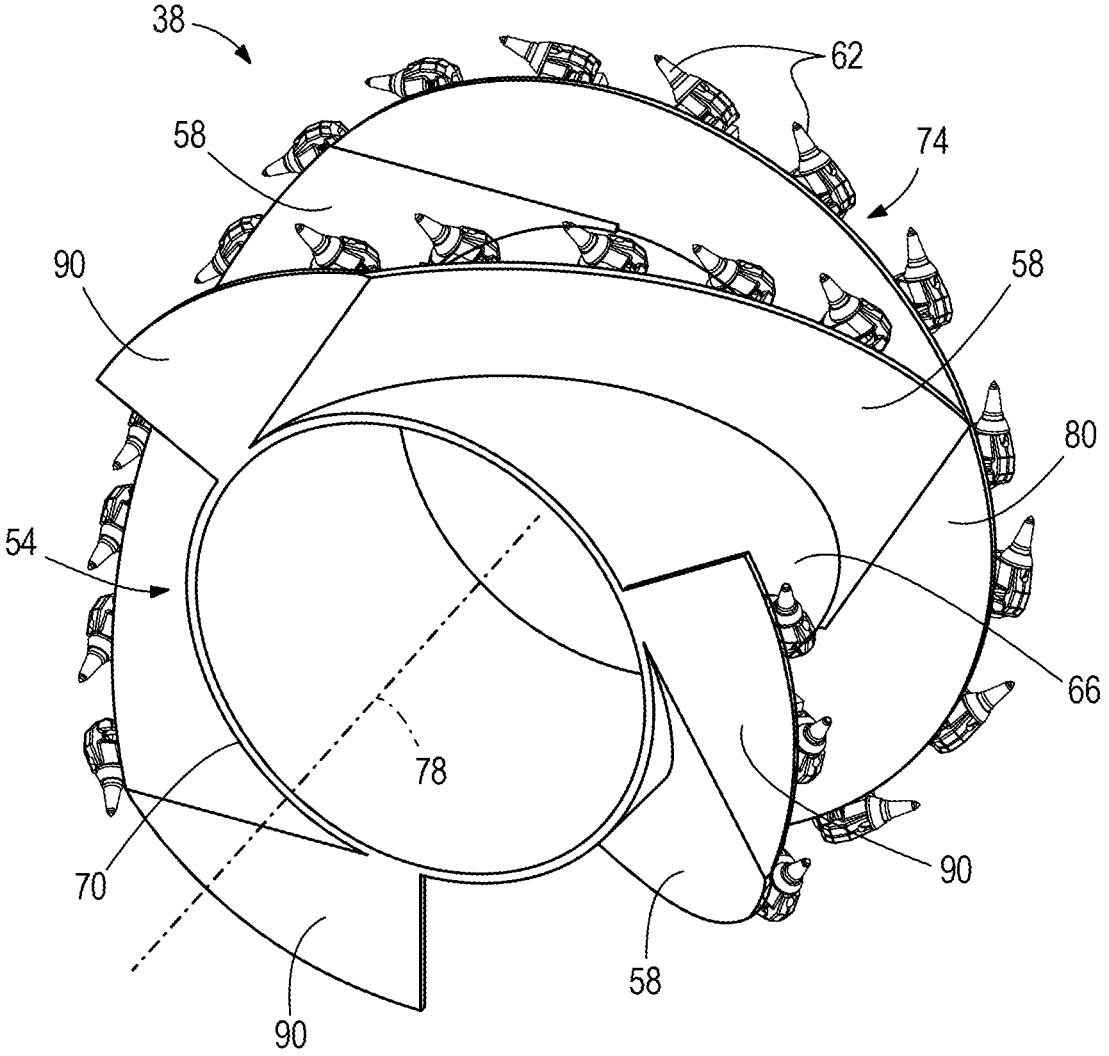
FIG. 3 is a rear perspective view of a cutting head.
Figure 4:
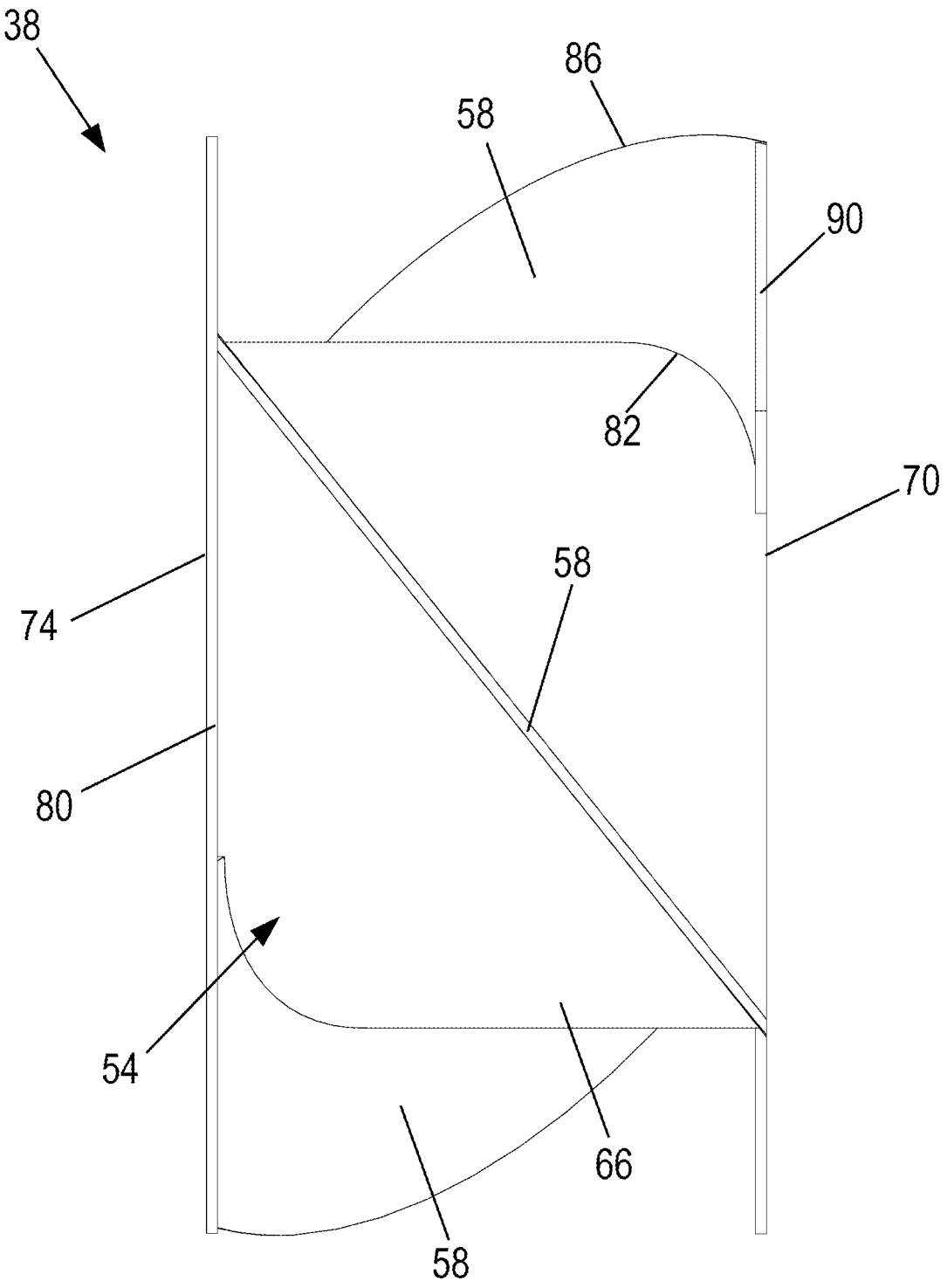
FIG. 4 is a side view of the cutting head of FIG. 3 with cutting bit assemblies omitted.

FIGS. 3 and 4 illustrate a cutting head 38. Although the cutting bit assemblies 62 are shown in FIG. 3, the cutting bit assemblies are omitted from FIG. 4 for clarity/simplicity. The cutting bit assemblies 62 may include a cutting bit having a tip for engaging a rock surface, and a bit block for releasably securing the cutting bit. In some embodiments, the cutting bit assemblies 62 may include other components. Also, in the illustrated embodiment, each of the cutting bit assemblies 62 are supported on a surface of one of the vanes 58; in other embodiments, the cutting bit assemblies may be supported on a different surface, and/or the cutting bit assemblies may be supported on the drum 54.

In the illustrated embodiment, the drum 54 has a generally cylindrical outer surface 66. The drum 54 has a first end or discharge end 70 and a second end or face end 74, and a drum axis 78 extends between the discharge end 70 and the face end 74. The discharge end 70 is pivotably coupled to the ranging arm 34 (FIG. 2), and the face end 74 is configured to be positioned adjacent the mine face 22 (FIG. 2). A face ring or face plate 80 is positioned around at least a portion of the face end 74. The cutting bit assemblies 62 (FIG. 3) are supported on the vanes 58 and face plate 80. In the illustrated embodiment, the cutting bit assemblies 62 are supported on a side of the face plate 80 proximate the mine face 22; in other embodiments, the cutting bit assemblies may be secured to another side or portion of the face plate 80, and/or may be secured to a portion of the drum 54. As the drum 54 rotates about the drum axis 78, the tips of the cutting bit assemblies 62 (FIG. 3) engage the mine face 22.

The vanes 58 are connected to the drum 54 (e.g., by welding) and extend along the periphery of the drum 54 between the discharge end 70 and the face end 74. In the illustrated embodiment, the cutting head 38 includes three vanes 58; in other embodiments, the cutting head 38 may include fewer or more vanes 58. The vanes 58 provide channels for cut material to flow. As the cutting head 38 rotates during the cutting operation, the cut material is driven along the surface of the vane 58 toward the discharge end 70, thereby carrying the cut material away from the cutting head 38. In some embodiments, the cut material is deposited onto a conveyor for further carrying the cut material.

As best shown in FIG. 4, each vane 58 includes one or more planar segments. In the illustrated embodiment, an inner edge 82 of each vane 58 is connected (e.g., via welding) to the outer surface 66 of the drum 54, and the inner edge 82 follows the profile of the outer surface 66. In addition, an outer edge 86 of the vane 58 is positioned at an outer periphery of the cutting head 38. The outer edge 86 may be formed to have a desired contour/shape. Furthermore, each vane 58 is connected to a discharge plate 90 positioned adjacent the discharge end 70. In the illustrated embodiment, the discharge plate 90 is oriented perpendicular to the drum axis 78. In addition, the vane 58 is connected to the face plate 80 positioned adjacent the face end 74 of the drum 54.

Rather than using helical or spiral shaped vanes which may require multiple bending and fitting steps, the planar shape of the vane 58 simplifies manufacture and assembly of the cutting head 38 and simplifies attachment of the cutting bit assemblies 62 (FIG. 1). In some embodiments, each vane 58 includes multiple planar segments.

Figure 5:
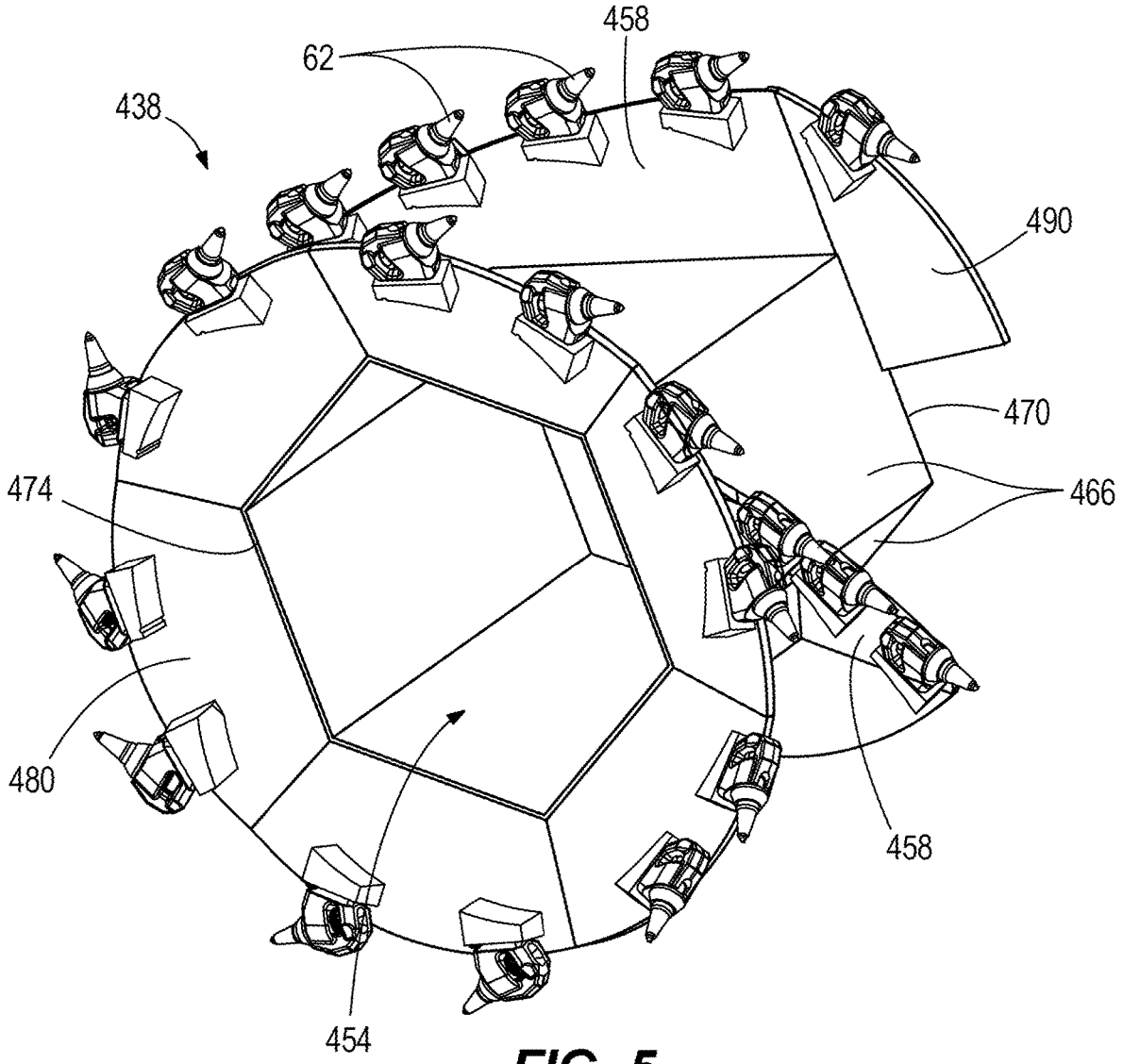
FIG. 5 is a perspective view of a cutting head.
Figure 6:
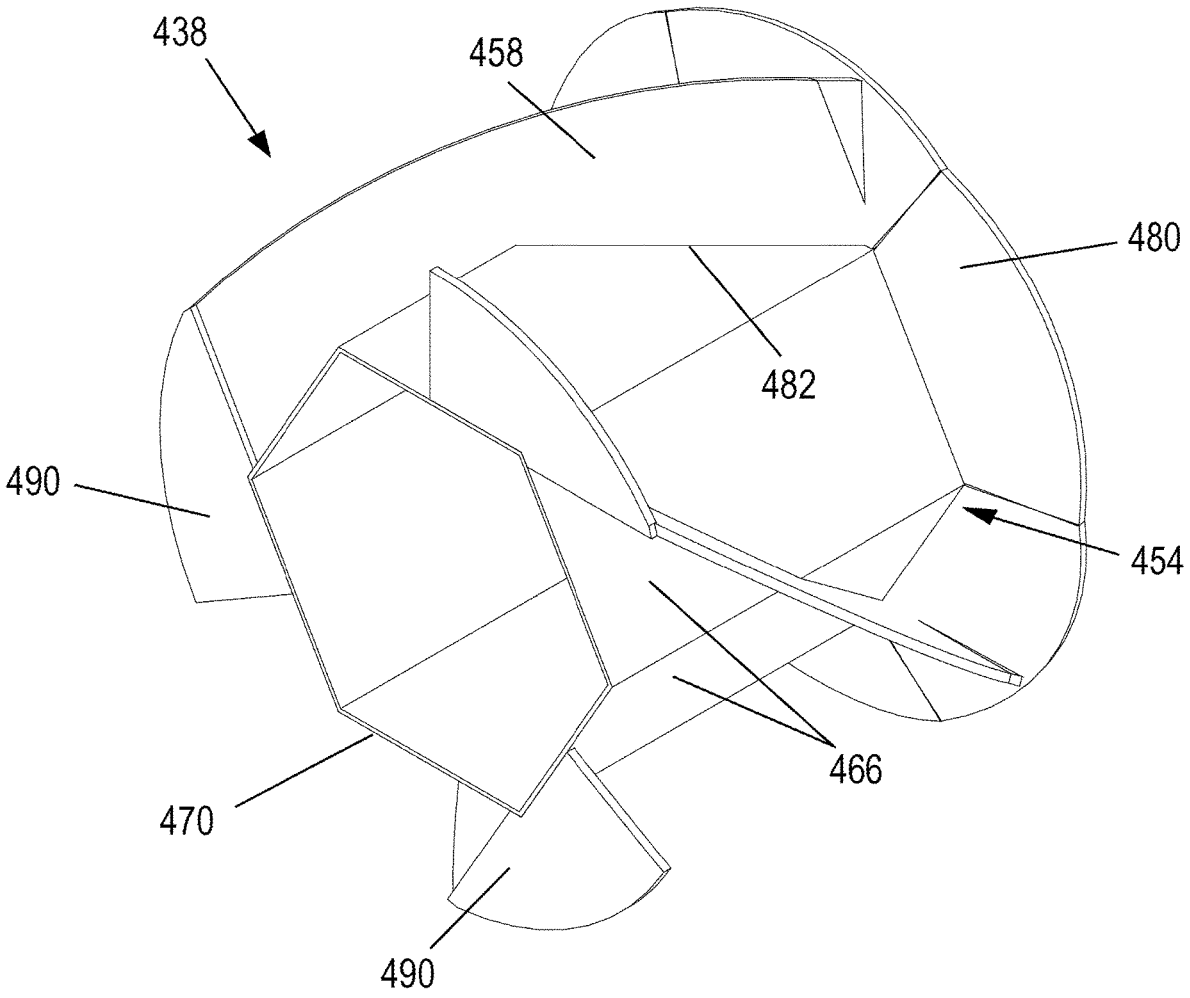
FIG. 6 is a rear perspective view of the cutting head of FIG. 5 with cutting bit assemblies omitted.

FIGS. 5-8 illustrate a cutting head 438 according to another embodiment. The cutting head 438 includes a drum 454 and flights or vanes 458. The drum 454 also includes a face plate 480 proximate a face end 474, which in the illustrated embodiment is formed as a plurality of planar segments. Similar to the drum 54 of FIGS. 3 and 4, FIG. 5 illustrates the cutting bit assemblies 62 according to one embodiment, the cutting bit assemblies are omitted from FIGS. 6-8 for clarity/simplicity. Each of the cutting bit assemblies 62 in the illustrated embodiment are supported on a surface of one of the vanes 458; in other embodiments, the cutting bit assemblies may be supported on a different surface, and/or the cutting bit assemblies may be supported on the drum 454. It is understood that the vanes 458 and the face plate 480 support a plurality of cutting bit assemblies.

Figure 7:
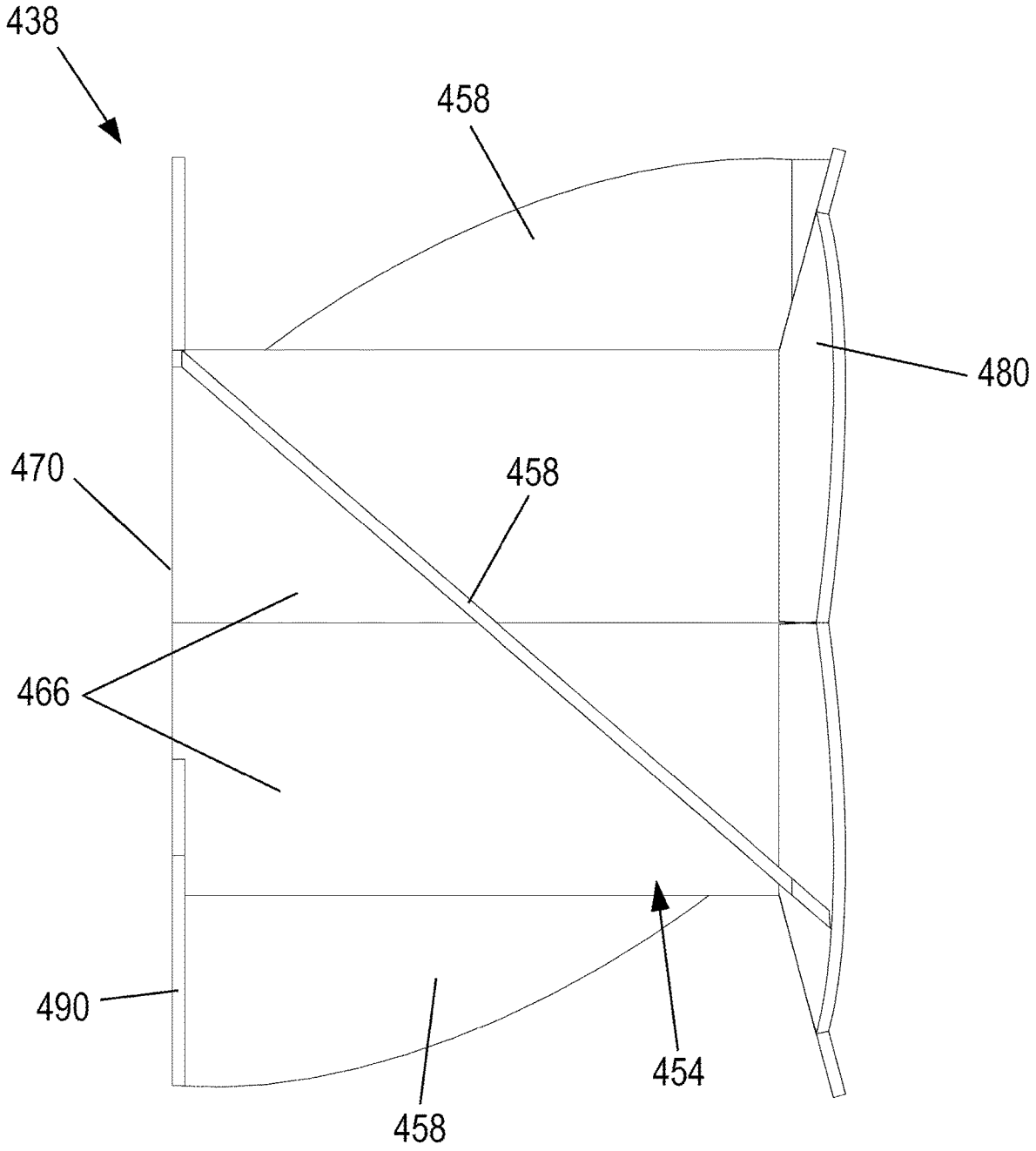
FIG. 7 is a side view of the cutting head of FIG. 5 with cutting bit assemblies omitted.
Figure 8:
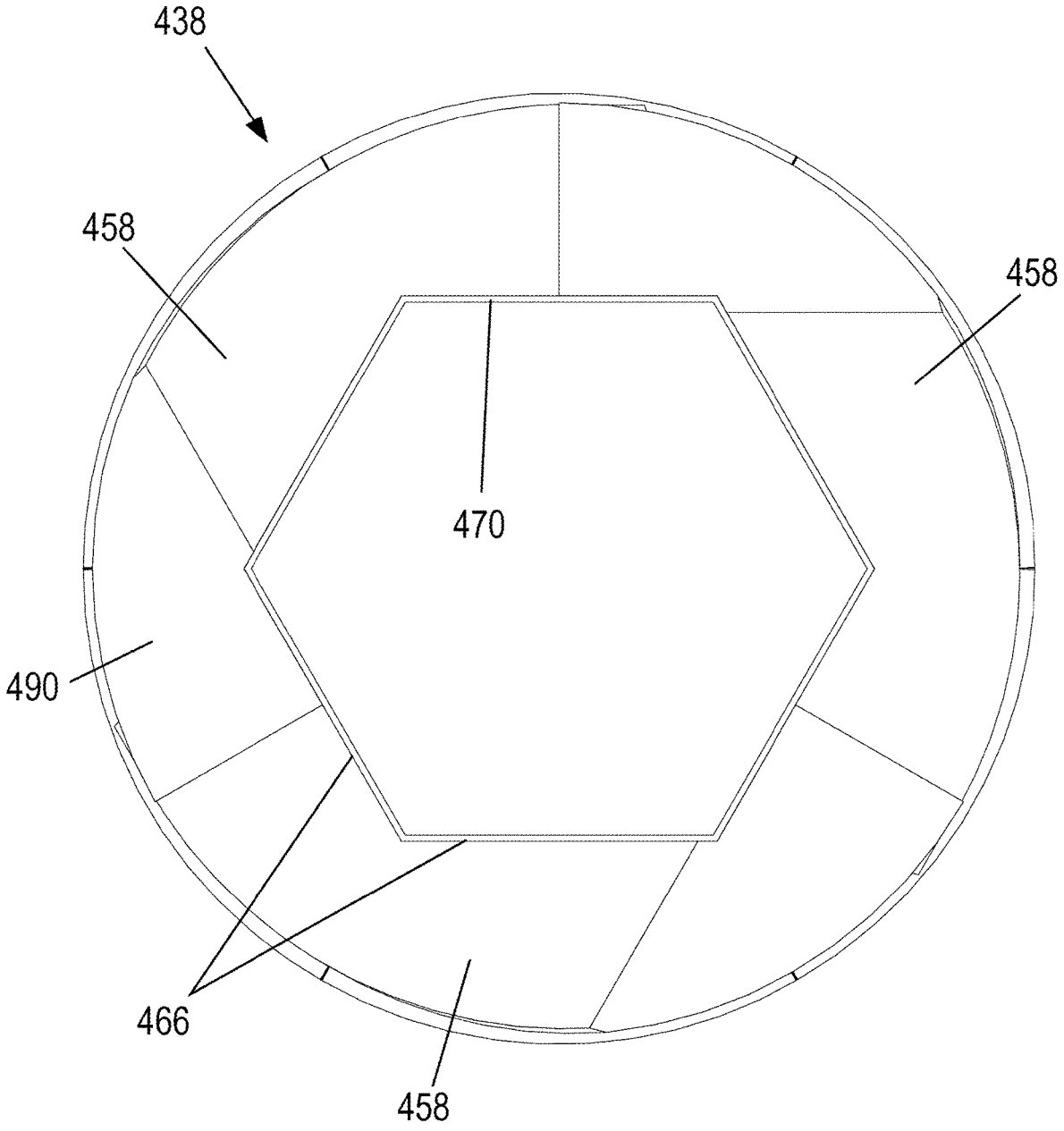
FIG. 8 is a rear end view of the cutting head of FIG. 5 with cutting bit assemblies omitted.

The drum 454 has a polygonal profile formed by a plurality of planar walls 466 extending between a discharge end 470 and the face end 474. In the illustrated embodiment, the drum 454 has a hexagonal shape formed by six planar walls 466; in other embodiments the drum 454 may include fewer or more walls. The drum 454 can be formed by connecting multiple flat plates to form a shell, thereby simplifying the manufacture and assembly of the cutting head 438. The vanes 458 may be formed as one or more planar segments, and each vane 458 includes an inner edge 482 connected to the planar walls 466. In the illustrated embodiment, each vane 458 extends across two planar walls 466 as the vane 458 extends between the discharge end 470 and the face end 474, and discharge plates 490 are positioned adjacent the discharge end 470. Furthermore, as shown in FIG. 7, in the illustrated embodiment the face plate 480 protrudes forward from the face end 474 of the drum 454. The face plate 480 can be formed as a plurality of separate plates, each of which is attached a respective one of the walls 466. In other embodiments, the face plate 480 may be formed as one or more plates oriented in a common plane (e.g., a plane perpendicular to the axis of rotation 78).

Although the aspects of the cutting head have been described above with respect to a longwall shearer, it is understood that the aspects could be incorporated onto various types of cutting heads and various types of mining machines.

Although aspects are described in detail above with reference to certain embodiments, variations and modifications exist within the scope and spirit of one or more independent aspects as described. Various features and advantages are set forth in the following claims.

What is claimed is:

1. A cutting head for a mining machine, the cutting head comprising:

a drum including a first end, a second end, and an outer surface, and the drum rotatable about a drum axis;

a vane coupled to the outer surface of the drum and protruding radially away from the drum axis, the vane including a unitary planar member extending at least partially around the drum axis and from the first end of the drum to the second end of the drum; and a cutting bit assembly positioned adjacent a surface of the vane.

2. The cutting head of claim 1, wherein an end of the vane proximate the first end of the drum is coupled to a face plate, and an end of the vane proximate the second end of the drum is coupled to a discharge plate.

3. The cutting head of claim 1, wherein the vane is a first vane, the cutting head further comprising at least one additional vane spaced apart from the first vane about the drum axis, the additional vane including at least one planar member.

4. The cutting head of claim 1, wherein the drum includes a face plate extending radially outwardly from the outer surface adjacent the first end, and a discharge plate extending radially outwardly from the outer surface adjacent the second end.

5. The cutting head of claim 1, wherein the drum has a cylindrical profile as viewed along the drum axis.

6. The cutting head of claim 1, wherein the drum has a polygonal profile as viewed along the drum axis.

7. The cutting head of claim 1, wherein the cutting bit assembly includes a bit removably secured within a bit block.

8. The cutting head of claim 1, wherein the cutting bit assembly is secured to at least one of the drum and the vane, the cutting bit assembly positioned adjacent a surface of the vane to facilitate loading of cut material onto the surface of the vane.

9. A cutting head for a mining machine, the cutting head comprising:

a drum including a first end and a second end, the drum rotatable about a drum axis, the drum including a plurality of planar walls extending between the first end and the second end;

a vane coupled to an outer surface of the drum, the vane protruding radially away and extending at least partially around the drum axis and extending from the first end of the drum to the second end of the drum; and a cutting bit assembly positioned adjacent a surface of the vane.

10. The cutting head of claim 9, wherein the drum includes a face plate extending radially outwardly from the outer surface adjacent the first end, and a discharge plate extending radially outwardly from the outer surface adjacent the second end, the face plate including a plurality of plates, each of the plates associated secured to an end of an associated one of the planar walls of the drum.

11. The cutting head of claim 9, wherein the drum has a polygonal profile as viewed along the drum axis.

12. The cutting head of claim 11, wherein the drum has a hexagonal profile as viewed along the drum axis.

13. The cutting head of claim 9, wherein the vane includes multiple planar segments.

14. The cutting head of claim 9, wherein the vane is a first vane, the cutting head further comprising at least one additional vane spaced apart from the first vane about the drum axis, the additional vane including at least one planar member.

15. The cutting head of claim 9, wherein the vane includes a planar member extending at least partially between the first end of the drum and the second end of the drum.

16. The cutting head of claim 9, wherein the cutting bit assembly includes a bit removably secured within a bit block.

17. The cutting head of claim 9, wherein the cutting bit assembly is secured to at least one of the drum and the vane, the cutting bit assembly positioned adjacent a surface of the vane to facilitate loading of cut material onto the surface of the vane.

18. The cutting device of claim 9, wherein the vane extends across a portion of the outer surface of the drum, an inner edge of the vane contacting more than one of the planar walls of the drum.

19. A cutting device for a rock cutting machine, the cutting device comprising:

an arm supported for pivoting movement;

a drum including a first end and a second end, the first end of the drum supported on the arm, the drum rotatable relative to the arm about a drum axis, the drum including a plurality of planar surfaces forming a polygonal profile;

a vane coupled to the outer surface of the drum, the vane protruding radially away from and extending partially around the drum axis, the vane including a unitary planar member extending at least partially around the drum axis and from the first end of the drum to the second end of the drum; and a plurality of cutting bit assemblies secured to at least one of the drum and the vane, each of the cutting bit assemblies positioned adjacent a surface of the vane to facilitate loading of cut material onto the surface of the vane.

20. The cutting device of claim 19, wherein the drum has a polygonal profile as viewed along the drum axis.

21. The cutting device of claim 19, wherein the vane includes multiple planar segments.

* * * * *